US005129532A

United States Patent [19]

Martin

[11] Patent Number: 5,129,532

[45] Date of Patent: Jul. 14, 1992

[54] PEDIATRIC-MEDICINAL DISPENSING SYSTEM

[76] Inventor: Charlene S. Martin, 5604 Timmerman Way, Citrus Heights, Calif. 95621

[21] Appl. No.: 560,075

[22] Filed: Mar. 30, 1990

[51] Int. Cl.[5] ..... A61J 7/00; A61J 11/00

[52] U.S. Cl. ..... 215/11.1; 604/77; 606/236

[58] Field of Search ..... 215/11.1; 606/234, 236; 604/77

[56] References Cited

U.S. PATENT DOCUMENTS

| | | | |
|---|---|---|---|
| 1,082,198 | 12/1913 | Jencsa | 128/890 |
| 1,531,245 | 3/1925 | Ozanne | 222/490 |
| 1,582,003 | 4/1926 | Griffiths | 606/236 |
| 2,588,069 | 3/1952 | Allen | 216/11.1 |
| 2,680,441 | 6/1954 | Krammer | 215/11.1 X |
| 2,824,561 | 2/1958 | Mueller | 215/11.1 |
| 2,836,321 | 5/1958 | Soltesz et al. | 215/11.1 |
| 2,889,829 | 6/1959 | Tannenbaum et al. | 215/11.1 X |
| 3,077,279 | 2/1963 | Mitchell | 215/11.1 |
| 3,211,315 | 10/1965 | Griesinger | 215/11.1 |
| 3,426,755 | 2/1969 | Clegg | 215/11.1 X |
| 3,645,413 | 2/1972 | Mitchell | 215/11.5 X |
| 3,682,344 | 8/1972 | Lopez | 215/11.1 |
| 3,964,509 | 6/1976 | Daubenberger et al. | 222/490 X |
| 4,078,566 | 3/1978 | Urban, Jr. | 604/77 X |
| 4,488,551 | 12/1985 | Connelly | 606/236 |
| 4,520,809 | 6/1985 | de Greff et al. | 604/77 X |
| 4,765,497 | 8/1988 | Hsu | 222/490 X |
| 4,784,641 | 11/1988 | White | 215/11.1 X |
| 4,821,895 | 4/1989 | Roskilly | 215/11.1 |

FOREIGN PATENT DOCUMENTS

| | | | |
|---|---|---|---|
| 1120990 | 7/1956 | France | 606/234 |
| 20508 | of 1912 | United Kingdom | 606/234 |

*Primary Examiner*—Sue A. Weaver
*Attorney, Agent, or Firm*—Bernhard Kreten

[57] ABSTRACT

A pediatric medicinal dispensing device which allows oral ingestion of medicine by an infant. The dispenser includes a top portion formed as a nipple to be received by an infant and a sealed housing and bottom wall. The bottom wall includes an inlet so that medicine may be inserted within an interior of the device and thereafter orally ingested by an infant's sucking motion.

4 Claims, 1 Drawing Sheet

PEDIATRIC-MEDICINAL DISPENSING SYSTEM

FIELD OF THE INVENTION

Figure 1:
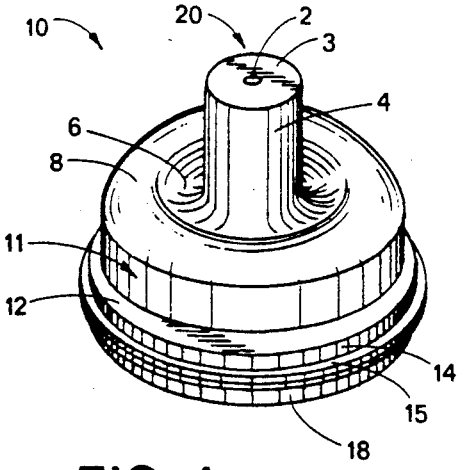

The following invention relates generally to the field of administering doses of medicine. Specifically, an enclosed, nipple-like dispenser is disclosed which increases the likelihood of acceptance by an infant and decreases the likelihood of contamination.

BACKGROUND OF THE INVENTION

To provide oral medication to an infant is an arduous task. Infants and young children are frequently prescribed medicine that must be given orally during the first year of their life.

Commonly prescribed medications are antibiotics for ear infections and remedies for upper respiratory infections.

Although the ingestion of the proper amount of medicine is important to the improved health and well being of an infant, infants are rarely cooperative. A dual process exists, first the infant must accept the medicine orally and second, the infant must swallow the medicine. Frequently once infants have allowed the medicine to be placed in their mouth, they spit out the medicine.

This process is frustrating to the parent not only because of the infant's refusal to accept the medicine, but also because parents feel they are not properly taking care of their child.

Devices and methods have been developed to aid in the dispensing process of oral medicine, but none involves the use of a disposable system in which a nipple conforming to an infant's expectations has a hollow interior and a bottom wall fixed to the nipple defining a sealed interior. The bottom wall has a portal to allow medicine to be injected within the sealed container.

Syringe applicators and modified spoons inadequately perform the function of dispensing medicine. These devices are foreign to an infant and are frequently rejected by tightly closed lips.

The following patents reflect the state of the art of which applicant is aware, insofar as these patents appear to be germane to the patent process. These patents are disclosed with a view towards discharging applicant's acknowledged duty to disclose relevant prior art. However, it is respectfully submitted that none of these patents teaches the claimed invention when considered singly, and none of the patents renders obvious the instant invention when considered in any conceivable combination.

| INVENTOR | PATENT NO. | ISSUE DATE |
|---|---|---|
| JENCSA | 1,082,198 | Dec. 23, 1913 |
| OZANNE | 1,531,245 | March 24, 1925 |
| DAUBENBERGER, et al. | 3,964,509 | June 22, 1976 |
| HSU | 4,765,497 | Aug. 23, 1988 |

The prior art lacks a medical dispensing device that meets the expectations of all babies. Whether a baby is bottle fed or breast fed, a nipple dispensing device would overcome an infant's initial rejection of medicine.

Additionally, the dispensing devices in the prior art lack a bottom wall coupled to a nipple thereby defining a sealed interior. A portal allows medicine to be injected therein.

SUMMARY OF THE INVENTION

This invention relates generally to a device for dispensing oral medication to an infant or young child.

More particularly, the invention describes a dispensing delivery system in which a top portion is formed as a nipple and a remainder of the delivery system includes an interior which communicates with a nipple outlet located medially on a top wall of the nipple and an annular body housing and bottom wall housing. The bottom wall of the housing further includes a syringe admitting inlet for the insertion of medicine within the hereinabove mentioned interior of the delivery system.

In deployment, a wrapper is taken off the delivery system, a specific amount of medicine is injected through the inlet in the bottom wall to the interior of the annular body housing and nipple.

The nipple is placed in an infant's mouth and the infant sucks the nipple, extracting the medicine from the system. When all of the medicine is depleted the system may be thrown away.

OBJECTS OF THE INVENTION

Accordingly, a primary object of this invention is to provide a useful and novel dispensing device for the administration of oral medicine to an infant.

It is yet a further object of this invention to provide a device as characterized above in which the dispensing device is formed from a nipple, thereby lending itself to conform to an infant's expectations, and the remaining dispenser includes an interior which communicates with a nipple outlet, sidewalls and a bottom wall, wherein the bottom wall contains an inlet to allow medicine to be injected therein.

Still another object of this invention is to provide a useful and novel dispensing device as characterized above which is simple in construction and is extremely safe to use.

Another object of this invention is to provide a device as characterized above wherein a long-felt yet heretofore unfilled need of providing a method for dispensing oral medicine to an infant may be practiced with relative ease without an infant's rejection.

Viewed from one vantage point, it is an object of the present invention to provide a method for dispensing medicine orally to an infant by inserting and retaining the medicine within the device, placing the dispenser in an infant's mouth by orienting the mouth to a nipple on the dispenser, allowing the infant to suck from the nipple of the dispenser thereby causing the medicine to flow through the sealed interior and into the infant's mouth.

Viewed from yet another vantage point, it is an object of the present invention to provide a medicator for dispensing medicaments which includes a housing having an inlet and an outlet, a medicament storage area between said inlet and outlet, wherein the inlet is formed as a nipple for use by a baby.

Viewed from yet another vantage point, it is an object of the present invention to provide a medicator for dispensing medicaments which includes a housing having an inlet and an outlet, a medicament storage area between said inlet and outlet wherein the medicator defines a closed container except for said inlet and outlet, and said inlet includes a vent means.

Viewed from yet another vantage point, it is a further object of the present invention to provide a sterile, disposable medicator for dispensing medication which is comprised of flexible material which does not collapse while in use.

Viewed from yet another vantage point, it is a further object of the present invention to provide a sterile, disposable medicator for dispensing medication to an infant wherein the dispenser can be filled with medication, closed and utilized with relative ease.

These and other objects will be made manifest when considering the following detailed specification and when taken in conjunction with the appended drawing figures wherein there has been provided an instrumentality which facilitates the administration of oral medicine to an infant or young child including a nipple, an annular body housing, a bottom wall with an inlet and a means to allow the injection of medicine into the thus formed dispensing device.

BRIEF DESCRIPTION OF THE DRAWING FIGURES

FIG. 1—Depicts a perspective view of one side of the pediatric-medicinal delivery system.

Figure 3:
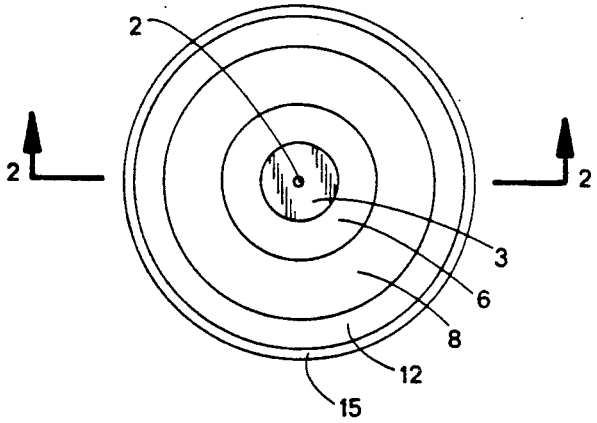
Figure 2A:
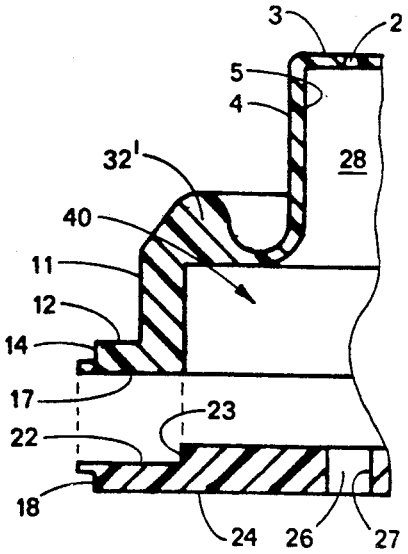
Figure 2B:
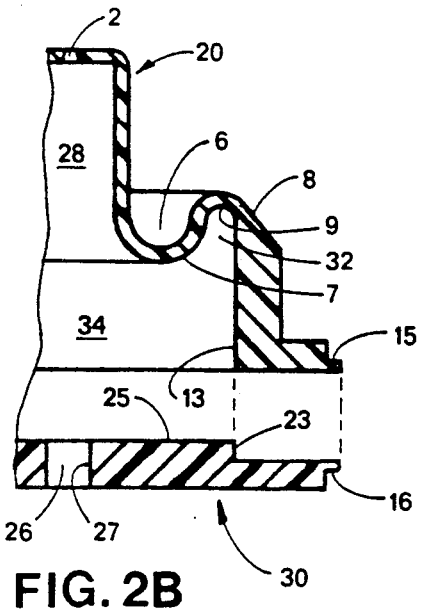

FIGS. 2A and 2B—show a side view cross section of the pediatric-medicinal system split at the center of the nipple as shown by the lines 2—2 of FIG. 3. FIGS. 2A and 2B reflect two variants of nipples.

FIG. 3—Shows a top view of that, which is shown in FIG. 1.

Figure 4:
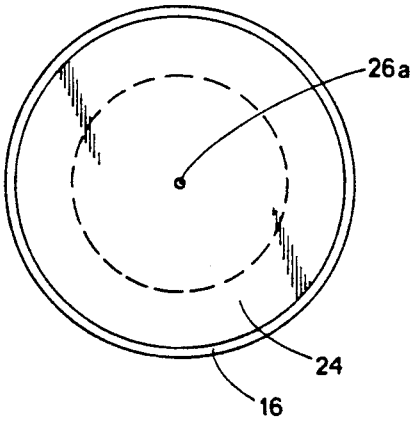

FIG. 4—Depicts a bottom view of that which is shown in FIG. 1 and shows a rounded inlet for receiving a syringe with medicine.

Figure 5:
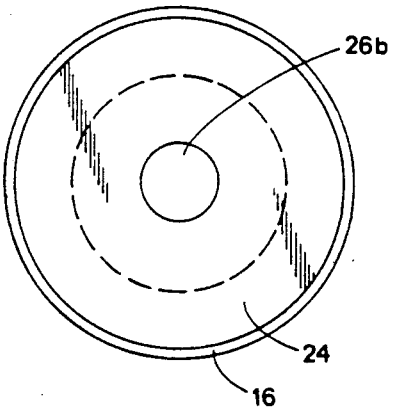

FIG. 5—Depicts an alternative configuration to that which is shown in FIG. 4 and utilizes an enlarged inlet with a plug stopper for receiving medicine from a non-syringe type device.

BRIEF DESCRIPTION OF THE PREFERRED EMBODIMENT

Considering the drawings now, wherein like numerals refer to like parts throughout the various drawing figures, reference numeral 10 is directed to the dispensing delivery system according to the present invention.

The dispensing delivery device 10 is formed from F.D.A. approved flexible material such as PVC. As shown in FIGS. 2A and 2B the delivery device includes a nipple 20, an annular body housing 11, and a bottom wall housing 30. The annular body housing 11 and bottom wall housing 30 are preferably heat sealed together. The bottom wall housing 30 includes an inlet 26 for the injection of medicine. The inlet 26 communicates with a sealed interior 40 and sequentially with the sealed cylindrical nipple interior 28. Upon deployment medicine passes through the interior of the delivery system and a nipple outlet 2 to an infant's mouth.

The nipple 20 includes the nipple outlet 2 medially located on a circular top wall 3. The circular top wall 3 communicates with a downwardly extending cylindrical sidewall 4.

As shown in FIG. 2, the cylindrical sidewall 4 has an inner wall 5 defining a sealed cylindrical nipple interior 28. The cylindrical sidewall 4 extends and curves to a semi-toroidal trough 6 forming a parabolic structure when viewed in section.

Integral with the semi-toroidal trough 6 and extending downwardly from the upper and outer portion of the trough 6 is an outer chamfer 8 angled downwardly and connecting to the annular body housing 11.

The annular body housing 11 adjoins substantially perpendicularly to a top surface of a radially extending shoulder 12 which is also substantially perpendicular to and leads to an annular step 14. The annular step 14 connects perpendicularly to a radially extending flange 15.

The annular body housing 11 includes an interior housing wall 13. The interior may have an upper crested area 9 (FIG. 2B) that peaks and forms a vaulted upper interior 32 when considered with a U-shaped portion 7 which in turn leads to the inner wall 5 of the cylindrical sidewall 4. FIG. 2A shows the vaulted interior 32 filled in with PVC as an alternative as shown at 32.

The housing 11 has a bottom surface 17 which joins with the bottom wall housing 30. As shown in FIG. 2, the bottom wall housing 30 includes an outer bottom wall surface 24 and an inner bottom wall surface 25. The inner bottom wall surface defines a lower surface 25 of the sealed interior 40.

The inner housing wall 13 joins with the inner bottom wall surface 25 at an interior shelf 22 which seals to the bottom surface 17 of the radially extending shoulder 12 and at step 23 between bottom wall surface 25 and shelf 22.

The outer bottom wall surface 24 leads to a vertically extending lip 18 which adjoins at substantially right angles to a bottom peripheral flange 16. The peripheral flange 16 and a top peripheral flange 15 which extends radially from step 14 are sealed together.

An inlet 26 centrally passes through bottom wall housing 30 at the outer bottom wall 24 and inner bottom wall 25. More particularly, note that the primary difference between that which is shown in FIG. 4 and FIG. 5 is the relative difference of the shape of the inlet 26. FIG. 5 is adapted to accommodate an enlarged plug **26*b* occluding inlet 26 opposed to a smaller pin-hole type circular inlet 26*a* as seen in FIG. 4. Inlet 26*a* favors use of a syringe in a professional medicine dispensing environment while inlet 26*b* lends itself to home use of a spoon type implement for inserting medication. With an inlet 26, typically having an opening about one-half inch, medicine can be poured into the inlet and then a plug 26*b* can occlude the inlet 26. Syringe inlet 26*a*** is self-sealing typically and requires no plug.

The inlet 26 allows the placement of medicine into the sealed interior 40. The sealed interior 40 which holds a predetermined amount of medicine includes a sealed cylindrical nipple interior 28 in communication with the nipple outlet 2 at an upper portion and a substantially cylindrical shaped bottom sealed interior 34. The cylindrically shaped bottom sealed interior 34 is delineated by the inner bottom wall 25 and by the interior housing wall 13 on its side. The upper and outer portion of the cylindrically shaped bottom sealed interior 34 adjoins a toroidally shaped sealed interior 32 defined by the inner U-shaped wall portion 7 of the semi-toroidal trough 6, the upper portion of the interior housing wall 13 and the inner chamber wall 9 shown in FIG. 28. As mentioned, interior 32 is optional and may be filled in with the material defining the dispenser 10 as shown in FIG. 2A.

In use a prescribed amount of medicine would be inserted beyond the inlet 26 and would fill the sealed interior 40 and cylindrical nipple interior 28. An infant sucking on the nipple 20 would cause the medicine to flow from the interior of the dispensing device through the nipple outlet 2 into his/her mouth. Inlet 26 defines a bore 27 passing through the bottom wall housing 30. Collectively, the inlet 26 and bore 27 provide beneficial venting to allow the device to work properly in dispensing the medication without requiring the baby to collapse the device had there been no vent function. The syringe inlet 26a may be 0 dimensioned large enough to still allow venting, if desired.

Having thus described the invention, it should be apparent that numerous structural modifications and adaptations may be resorted to without departing from the scope and fair meaning of the instant invention as set forth hereinabove and as described hereinbelow by the claims.

I claim:

1. A disposable dispensing device for the oral administration of medicine, comprising, in combination:

a nipple (20) including a nipple outlet (2), an annular body housing (11) extending from said nipple, a bottom wall housing (30) containing an inlet (26) defining means to allow the placement of medicine into the dispensing device, wherein said annular body housing (11) further includes an annular step (14) including a top surface defining a radially extending shoulder (12) emanating from said annular body housing (11) and which said shoulder (12) is parallel to said bottom wall housing and perpendicular both to said annular step (14) and said annular body housing (11), a top peripheral flange (15) extending radially from said annular step (14) and leading to an annular bottom surface (17) oriented parallel to said shoulder (12), said annular bottom surface (17) communicates at right angles with an interior housing wall (13) of said annular body housing (11) and defines an opening in said annular body housing (11), wherein said bottom wall housing (30) includes: an outer bottom wall surface (24) and an inner bottom wall surface (25), a shelf (22) extending from said inner bottom wall surface (25) via a step (23) which is placed on said inner bottom wall surface (25) and which is dimensioned to contact said interior housing wall (13); said inner bottom wall surface (25) completes a sealed interior (40) by placement over said opening in said annular body housing (11) and attaches to said body housing (11) with both said interior housing wall (13) against said step (23) and said annular bottom surface (17) against said shelf (22), said bottom wall inlet (26) medially transverses through said outer and inner bottom wall surfaces (24, 25), said shelf (22) terminating in a peripheral flange (16) formed by an intersection of said shelf (22) and a vertically extending lip (18) which extends up from said outer bottom wall surface (24), such that said step (23) is located within said inner housing wall (13) and said flanges (15, 16) of said annular body housing and said bottom wall housing are of similar diameter and therefore in coincident registry and exteriorly accessible for sealing, wherein said nipple includes a circular top wall with said nipple outlet disposed medially thereon, a cylindrical sidewall further including an inner sidewall which defines a sealed cylindrical nipple interior, said nipple interior communicating with said nipple outlet, said cylindrical sidewall transitioned to a semi-toroidal trough cresting and joining an outer chamfered wall, wherein said interior housing wall (13) has an upper crested area that peaks thereafter forming an U-shape which joins with said inner sidewall, a lower end of said interior housing wall joins with said bottom wall housing slightly inboard said inner bottom wall surface (25), wherein said interior housing wall defines a sealed interior for receiving medication and in communication with said sealed cylindrical nipple interior and said bottom wall inlet, wherein said annular bottom surface (17) is heat sealed to said shelf (22) of said bottom wall housing (30).

2. A disposable dispensing device for the oral administration of medicine, comprising, in combination:

a nipple (20) including a nipple outlet (2), an annular body housing (11) extending from said nipple, a bottom wall housing (30) containing an inlet (26) defining means to allow the placement of medicine into the dispensing device, wherein said annular body housing (11) further includes an annular step (14) including a top surface defining a radially extending shoulder (12) emanating from said annular body housing (11) and which said shoulder (12) is parallel to said bottom wall housing and perpendicular both to said annular step (14) and said annular body housing (11), a top peripheral flange (15) extending radially from said annular step (14) and leading to an annular bottom surface (17) oriented parallel to said shoulder (12), said annular bottom surface (17) communicates at right angles with an interior housing wall (13) of said annular body housing (11) and defines an opening in said annular body housing (11), wherein said bottom wall housing (30) includes: an outer bottom wall surface (24) and an inner bottom wall surface (25), a shelf (22) extending from said inner bottom wall surface (25) via a step (23) which is placed on said inner bottom wall surface (25) and which is dimensioned to contact said interior housing wall (13); said inner bottom wall surface (25) completes a sealed interior (40) by placement over said opening in said annular body housing (11) and attaches to said body housing (11) with both said interior housing wall (13) against said step (23) and said annular bottom surface (17) against said shelf (22), said bottom wall inlet (26) medially transverses through said outer and inner bottom wall surfaces (24, 25), said shelf (22) terminating in a peripheral flange (16) formed by an intersection of said shelf (22) and a vertically extending lip (18) which extends up from said outer bottom wall surface (24), such that said step (23) is located within said inner housing wall (13) and said flanges (15, 16) of said annular body housing and said bottom wall housing are of similar diameter and therefore in coincident registry and exteriorly accessible for sealing, wherein said nipple includes a circular top wall with said nipple outlet disposed medially thereon, a cylindrical sidewall further including an inner sidewall which defines a sealed cylindrical nipple interior, said nipple interior communicating with said nipple outlet, said cylindrical sidewall transitioned to a semi-toroidal trough cresting and joining an outer chamfered wall, wherein said annular body housing includes said interior housing wall (13) having an interior planar horizontal top portion (32') defining a transition to said cylindrical nipple interior, wherein said interior housing wall defines a sealed interior for receiving medication and in communication with said sealed cylindrical nipple interior and said bottom wall inlet, wherein said annular bottom surface (17) is heat sealed to said shelf (22) of said bottom wall housing 30.

3. The device of claim 2 wherein said inlet (26) is configured as a pin-hole type circular inlet (26*a*).

4. The device of claim 2 wherein said inlet (26) is occluded by a plug (26*b*) after placement of medication through said inlet (26).

* * * * *